US007503372B1

(12) United States Patent
Jones

(10) Patent No.: US 7,503,372 B1
(45) Date of Patent: Mar. 17, 2009

(54) ROOF WORKER PROTECTIVE NETTING APPARATUS

(76) Inventor: Chris J. Jones, 201 Cedar Ravine Cir., #24, Colfax, CA (US) 95713

( * ) Notice: Subject to any disclaimer, the term of this patent is extended or adjusted under 35 U.S.C. 154(b) by 362 days.

(21) Appl. No.: 11/287,085

(22) Filed: Nov. 28, 2005

(51) Int. Cl.
*A47G 5/00* (2006.01)

(52) U.S. Cl. ..... 160/351; 256/31; 182/113

(58) Field of Classification Search ..... 160/351, 160/368.1; 256/DIG. 6, 28, 29, 30, 31, 45; 473/492, 494; 182/113, 112
See application file for complete search history.

(56) References Cited

U.S. PATENT DOCUMENTS

| | | | | | |
|---|---|---|---|---|---|
| 1,926,207 | A | * | 9/1933 | MacAlpine | 182/150 |
| 3,861,500 | A | * | 1/1975 | Dempsey | 182/204 |
| 3,880,405 | A | * | 4/1975 | Brueske | 256/59 |
| 3,901,481 | A | | 8/1975 | Probst | |
| D331,529 | S | | 12/1992 | Reinklou | |
| 5,221,076 | A | | 6/1993 | Zust | |
| 5,573,227 | A | | 11/1996 | Hemauer et al. | |
| 5,862,880 | A | | 1/1999 | Nelson et al. | |
| 5,884,725 | A | * | 3/1999 | Reyland | 182/82 |
| 5,896,944 | A | | 4/1999 | McMillian et al. | |
| 5,961,099 | A | * | 10/1999 | Thommen, Jr. | 256/12.5 |
| 6,053,281 | A | | 4/2000 | Murray | |
| 6,167,986 | B1 | | 1/2001 | Calvillo | |
| 6,585,080 | B2 | | 7/2003 | Murray | |
| 6,857,504 | B1 | * | 2/2005 | Branter | 182/113 |

* cited by examiner

*Primary Examiner*—Blair M. Johnson
(74) *Attorney, Agent, or Firm*—Sean A. Kaufhold

(57) ABSTRACT

A roof worker protective netting apparatus includes a plurality of posts. A plurality of upper loops is provided. Each of the upper loops is attached to one of the posts and adjacent to a respective top end of the posts. A flexible mesh panel has a top edge, a bottom edge, a first side edge and a second side edge. Each of a plurality of upper hooks is attached to the panel and is positioned adjacent to the top edge of the panel. The upper hooks are each removably couplable to one of the upper loops. Each of a plurality of straps is attached to the panel and positioned adjacent to the bottom edge. Fasteners are extendable through the straps and into a roof to removably secure the straps to the roof when the panel is positioned adjacent to and extends upwardly from a lower edge of the roof.

13 Claims, 7 Drawing Sheets

ROOF WORKER PROTECTIVE NETTING APPARATUS

BACKGROUND OF THE INVENTION

1. Field of the Invention

The present invention relates to protective guardrail devices and more particularly pertains to a new protective guardrail device for preventing workers and tools from sliding off of a roof.

2. Description of the Prior Art

The use of protective guardrail devices is known in the prior art. U.S. Pat. No. 3,901,481 describes a fence assembly that is attachable to an edge of a roof to provide a safety barricade for persons working on the roof. Another type of protective guardrail device is U.S. Pat. No. 5,221,076 having a plurality of hooks that are extendable into a roof and which may be attached to a fence with cables for the purpose of supporting the fence on the roof. Still yet another such device is found in U.S. Pat. No. 5,573,227 having fence mounts that are attachable to the edge of a building frame. Still another such device is found in U.S. Pat. No. 5,862,880.

While these devices fulfill their respective, particular objectives and requirements, the need remains for a device that may be attached to the bottom edge of a roof and extended upwardly from the roof so that a person is protected from falling off of the roof. Further, it is preferred that the device includes a mesh material that is attached to the roof in such a manner that any tools that may be drooped by a worker does not slide off of the roof.

SUMMARY OF THE INVENTION

The present invention meets the needs presented above by generally comprising a plurality of posts. Each of the posts has a bottom end and a top end. A plurality of upper loops is provided. Each of the upper loops is attached to one of the posts and is positioned adjacent to a respective one of the top ends. A flexible panel has a top edge, a bottom edge, a first side edge and a second side edge. The flexible panel comprises a mesh material. Each of a plurality of upper hooks is attached to the panel and is positioned adjacent to the top edge of the panel. The upper hooks are each removably couplable to one of the upper loops. Each of a plurality of straps is attached to the panel and positioned adjacent to the bottom edge. Fasteners are extendable through the straps and into a roof to removably secure the straps to the roof when the panel is positioned adjacent to and extends upwardly from a lower edge of the roof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
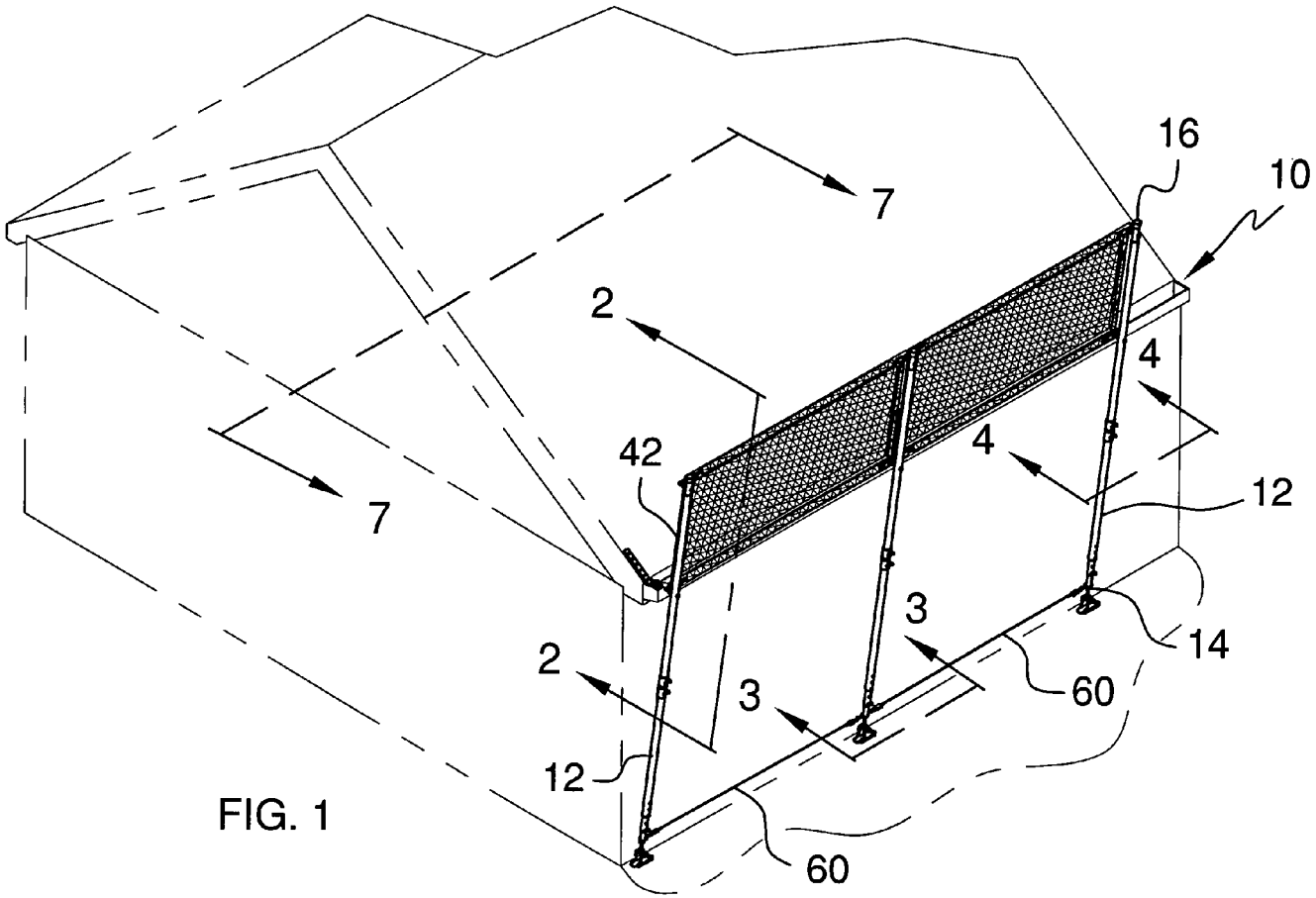
FIG. 1 is a perspective view of a roof worker protective netting apparatus according to the present invention.
Figure 2:
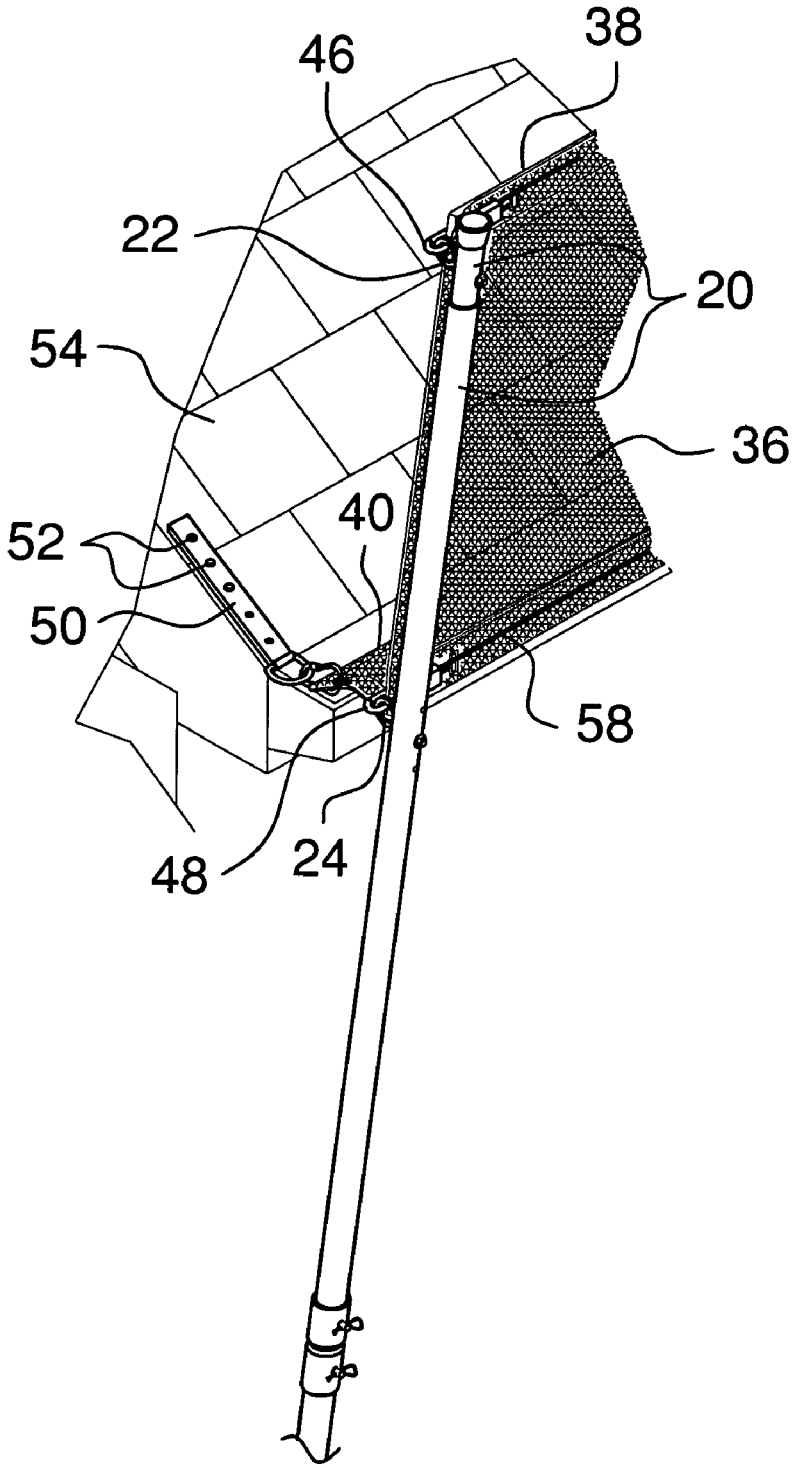
FIG. 2 is a perspective view of the present invention.
Figure 3:
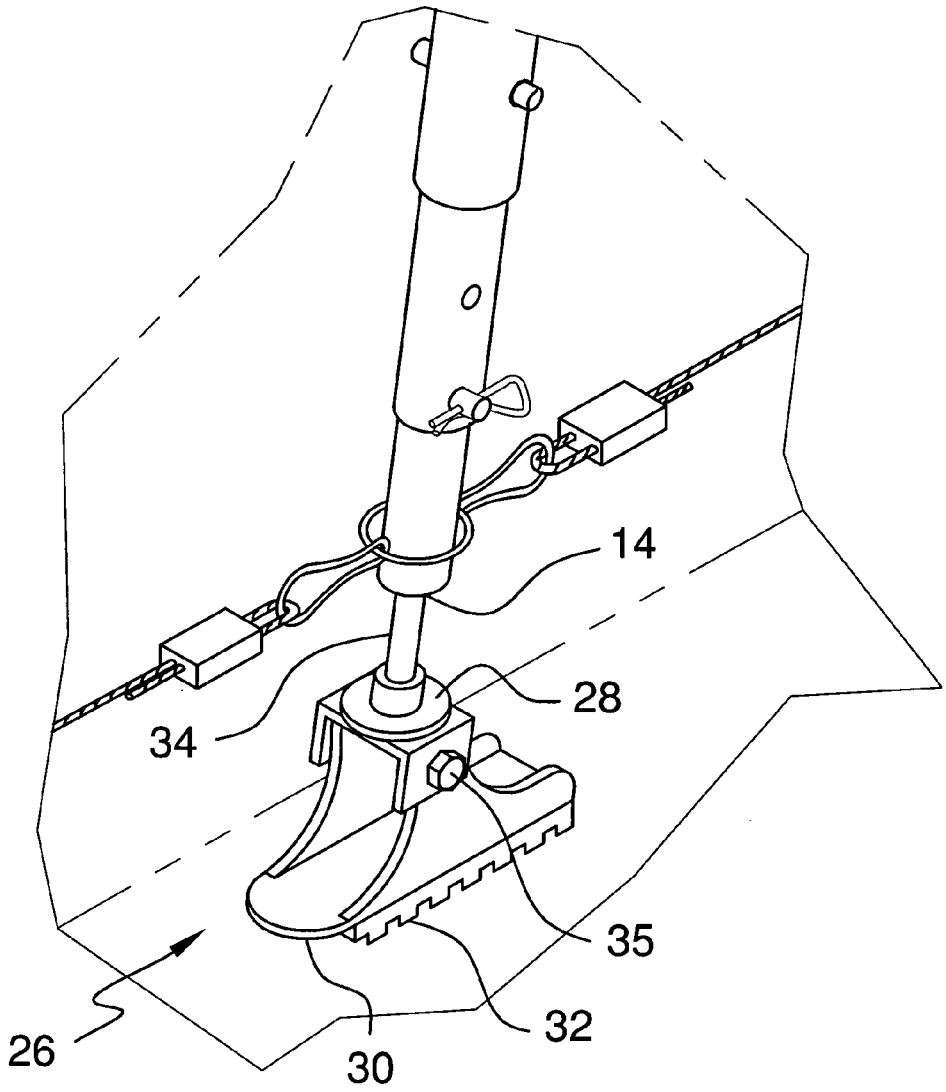
FIG. 3 is a perspective view of a foot assemblies of the present invention.
Figure 4:
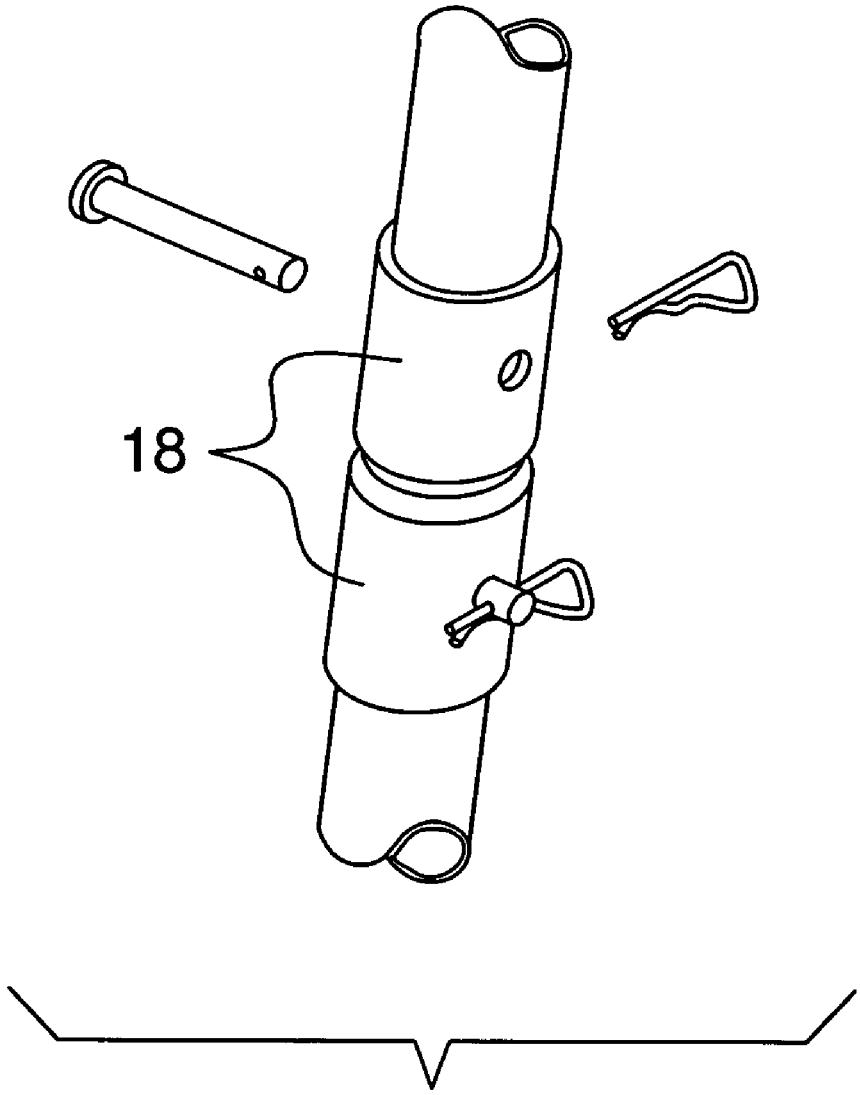
FIG. 4 is a perspective view of a post of the present invention.
Figure 5:
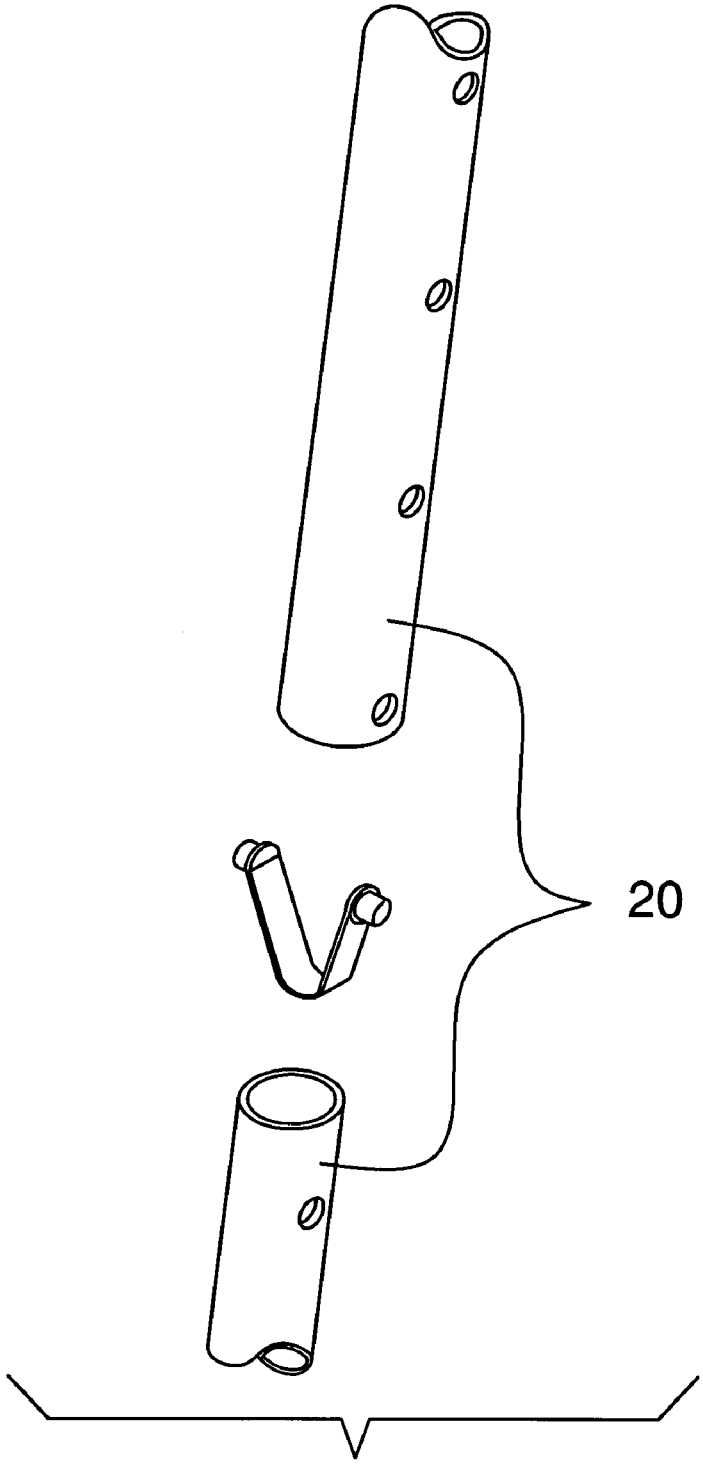
FIG. 5 is a perspective view of a post of the present invention.
Figure 6:
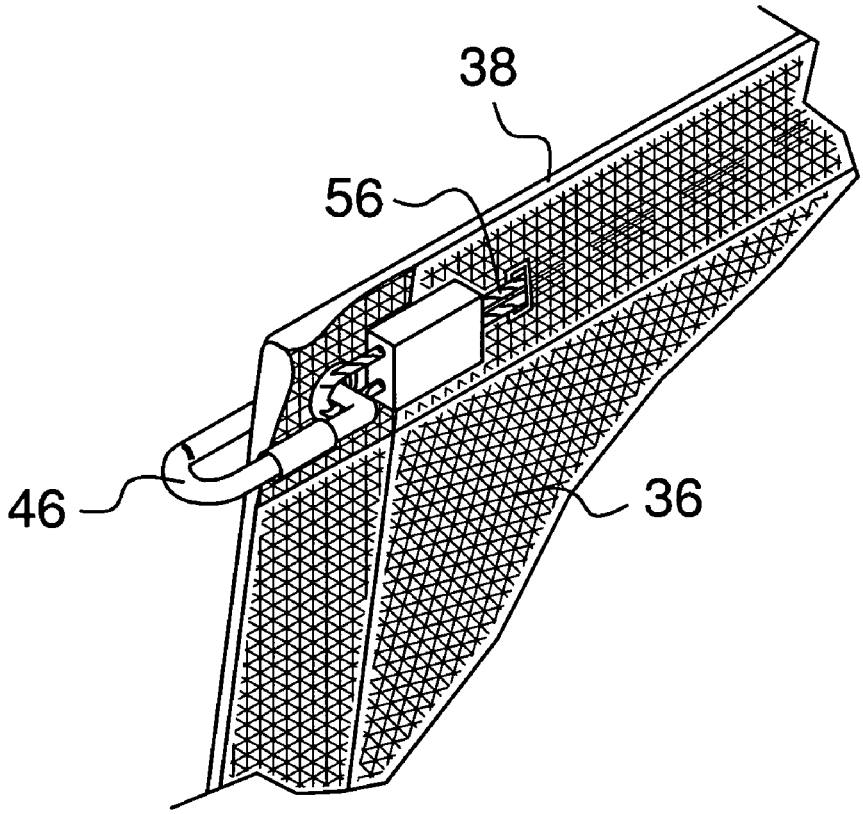
FIG. 6 is a perspective view of an upper edge of a flexible panel of the present invention.
Figure 7:
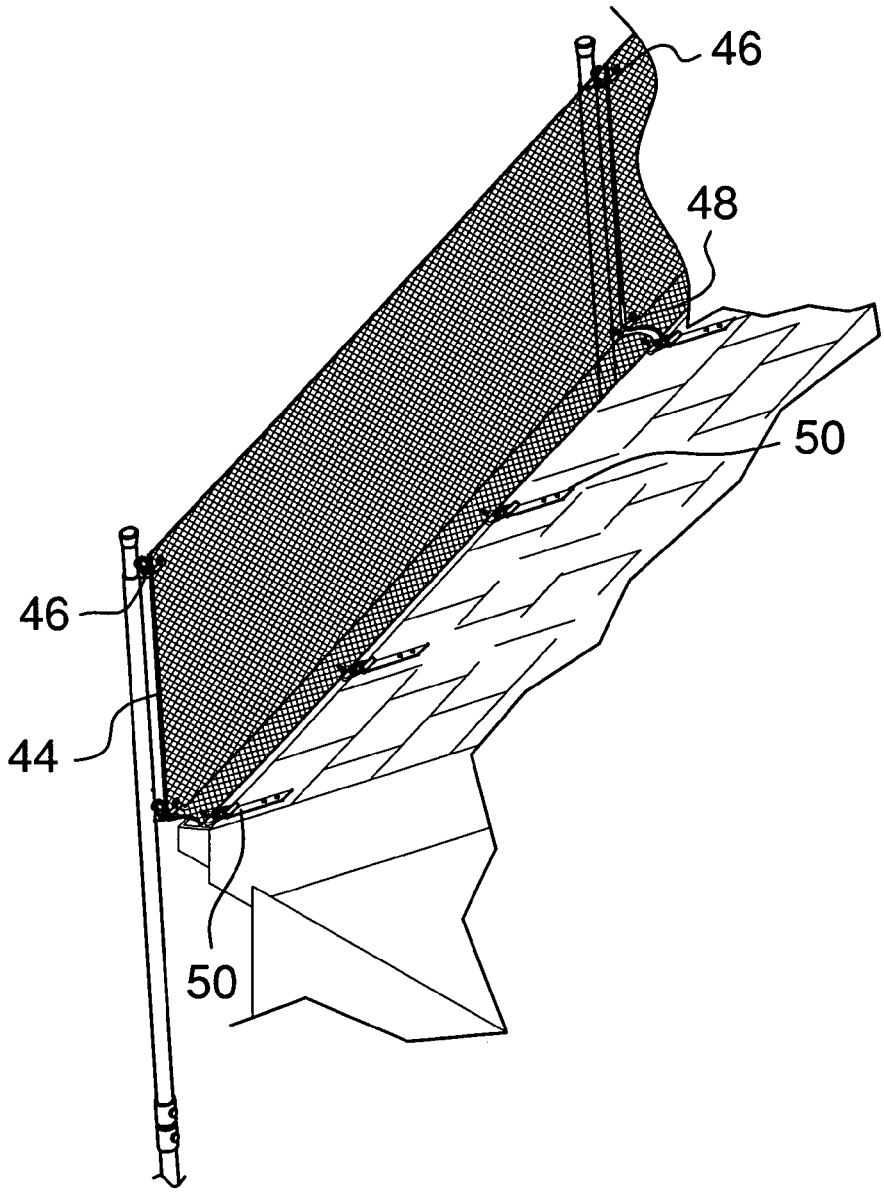
FIG. 7 is a perspective view of the panel of the present invention.

With reference now to the drawings, and in particular to FIGS. 1 through 7 thereof, a new protective guardrail device embodying the principles and concepts of the present invention and generally designated by the reference numeral 10 will be described.

As best illustrated in FIGS. 1 through 7, the roof worker protective netting apparatus 10 generally comprises a plurality of posts 12. Each of the posts 12 has a bottom end 14 and a top end 16. Each of the posts 12 is telescopic and has a selectable height. The selectable height is generally between 12 feet and 25 feet. The posts 12 may include removable sections 18, each having telescopic portions 20, for storage purposes.

A plurality of upper loops 22 and a plurality of lower loops 24 are provided. Each of the upper loops 22 is attached to one of the posts 12 and is positioned adjacent to a respective one of the top ends 16. Each of the lower loops 24 is attached to one of the posts 12 and is spaced from the top ends 16.

A plurality of foot assemblies 26 is also provided. Each of the foot assemblies 26 is attached to one of the bottom ends 14 of the posts 12. Each of the foot assemblies 26 includes a base 28 having a bottom side 30. The bottom side 30 has a plurality of teeth 32 extending away therefrom. A rod 34 is pivotally coupled to and extends upwardly from the base 28. The rod 34 is removably extendable into one of the bottom ends 14 of the posts 12. The rod 34 may be locked with a bolt 35 to prevent its movement with respect to the base 28.

A flexible panel 36 has a top edge 38, a bottom edge 40, a first side edge 42 and a second side edge 44. The flexible panel 36 comprises a mesh material and may be a conventional safety netting material.

Each of a plurality of upper hooks 46 is attached to the panel 36 and is positioned adjacent to the top edge 38 of the panel 36. At least one of the upper hooks 46 is positioned adjacent to the first side edge 42 and at least one of the upper hooks 46 is positioned adjacent to the second side edge 44. Each of the upper hooks 46 is removably couplable to one of the upper loops 22.

Each of a plurality of lower hooks 48 is attached to the panel 36 and is positioned nearer to the lower edge 40 than the top edge 38 of the panel 36. At least one of the lower hooks 48 is positioned adjacent to the first side edge 42 and at least one of the lower hooks 48 is positioned adjacent to the second side edge 44. Each of the lower hooks 48 is removably couplable to one of the lower loops 24.

A plurality of straps 50 is provided. Each of the straps 50 is attached to the panel 36 and is positioned adjacent to the bottom edge 40 of the panel 36. Each of a plurality of fasteners 52 is extendable through the straps 50 and into a roof 54. The straps 50 may be comprised of a flexible or a rigid material. The fasteners 52 removably secure the straps 50 to the roof 54 when the panel 36 is positioned adjacent to and extends upwardly from a lower edge of the roof 54. The straps 50 may be attached to the roof 54 and covered with shingles while the roof 54 is having shingles attached thereto. The straps 50 may then be removed from the panel 36 when work is completed while the straps 50 remain hidden under the shingles. This allows a person work all the way to the bottom edge of the roof 54 without having to remove the panel 36 first.

An upper tether 56 is attached to and extends between the upper hooks 46. A lower tether 58 is attached and extends between the lower hooks 48. A plurality of support cables 60 is provided. Each of the support cables 60 is attached to and extending between adjacent ones of the posts 12. The upper 56 and lower 58 tethers, as well as the support cables 60, increase the stability of the posts when they are vertically erected.

In use, each of the posts 12 is vertically orientated adjacent to a roof 54 and foot assemblies 26 are each properly pivoted with respect to the posts to ensure that the posts 12 are vertical. The panel 36 is attached to the posts 12 and a height of the posts 12 selected so that the panel 36 extends upwardly from a lower edge of the roof 54. The straps 50 are then secured to the roof 54. The panel 36 will catch objects that slide down the roof 54 and prevent workers from falling off of the roof 54.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A protective netting assembly for removably mounting on a roof, said assembly comprising:

a plurality of posts, each of said posts having a bottom end and a top end;

a plurality of upper loops, each of said upper loops being attached to one of said posts and being positioned adjacent to a respective one of said top ends;

a flexible panel having a top edge, a bottom edge, a first side edge and a second side edge, said flexible panel comprising a mesh material;

a plurality of upper hooks, each of said upper hooks being attached to said panel and being positioned adjacent to said top edge of said panel, each of said upper hooks being removably couplable to one of said upper loops;

a plurality of lower loops, each of said lower loops being attached to one of said posts and being spaced from said top and bottom ends, a plurality of lower hooks, each of said lower hooks being attached to said panel and being positioned nearer to said lower edge than said top edge of said panel, each of said lower hooks being removably couplable to one of said lower loops, said lower hooks being spaced from said bottom edge, a flap of said panel being defined between said lower hooks and said bottom edge, said flap being extendable laterally away from said posts to cover a gap between the roof and the posts and to form a catch to capture items sliding down the roof; and a plurality of straps, each of said straps being attached to and extending from said bottom edge of said panel, each of a plurality of fasteners being extendable through said straps and into the roof, said fasteners removably securing said straps to the roof when said panel is positioned adjacent to and extends upwardly from a lower edge of the roof.

2. The assembly according to claim 1, wherein each of said posts is telescopic and has a selectable height.

3. The assembly according to claim 2, wherein said selectable height is generally between 12 feet and 25 feet.

4. The assembly according to claim 1, wherein at least one of said upper hooks is positioned adjacent to said first side edge and at least one of said upper hooks is positioned adjacent to said second side edge, at least one of said lower hooks being positioned adjacent to said first side edge and at least one of said lower hooks being positioned adjacent to said second side edge.

5. The assembly according to claim 1, further including a plurality of foot assemblies, each of said foot assemblies being attached to one of said bottom ends of said posts.

6. The assembly according to claim 5, wherein each of said foot assemblies includes:

a base having a bottom side, said bottom side having a plurality of teeth extending away therefrom; and a rod being pivotally coupled to and extending upwardly from said base, said rod being removably extendable into one of said bottom ends of said posts.

7. The assembly according to claim 1, wherein said flexible panel comprises a mesh material.

8. The assembly according to claim 1, further including an upper tether being attached to and extending between said upper hooks.

9. The assembly according to claim 1, further including an upper tether being attached to and extending between said upper hooks.

10. The assembly according to claim 9, further including a lower tether being attached and extending between said lower hooks.

11. The assembly according to claim 10, further including a plurality of support cables, each of said support cables being attached to and extending between adjacent ones of said posts, said cabling being spaced from said panel.

12. The assembly according to claim 1, further including a plurality of support cables, each of said support cables being attached to and extending between adjacent ones of said posts.

13. A protective netting assembly for removably mounting on a roof, said assembly comprising:

a plurality of posts, each of said posts having a bottom end and a top end, each of said posts being telescopic and having a selectable height, said selectable height being generally between 12 feet and 25 feet;

a plurality of upper loops and a plurality of lower loops, each of said upper loops being attached to one of said posts and being positioned adjacent to a respective one of said top ends, each of said lower loops being attached to one of said posts and being spaced from said top and bottom ends;

a plurality of foot assemblies, each of said foot assemblies being attached to one of said bottom ends of said posts, each of said foot assemblies including;

a base having a bottom side, said bottom side having a plurality of teeth extending away therefrom;

a rod being pivotally coupled to and extending upwardly from said base, said rod being removably extendable into one of said bottom ends of said posts;

a flexible panel having a top edge, a bottom edge, a first side edge and a second side edge, said flexible panel comprising a mesh material;

a plurality of upper hooks, each of said upper hooks being attached to said panel and being positioned adjacent to said top edge of said panel, at least one of said upper hooks being positioned adjacent to said first side edge and at least one of said upper hooks being positioned adjacent to said second side edge, each of said upper hooks being removably couplable to one of said upper loops;

a plurality of lower hooks, each of said lower hooks being attached to said panel and being positioned nearer to said lower edge than said top edge of said panel, at least one of said lower hooks being positioned adjacent to said first side edge and at least one of said lower hooks being positioned adjacent to said second side edge, each of said lower hooks being removably couplable to one of said lower loops, said lower hooks being spaced from said bottom edge, a flap of said panel being defined between said lower hooks and said bottom edge, said flap being extendable laterally away from said posts to cover a gap between the roof and the posts and to form a catch to capture items sliding down the roof;

a plurality of straps, each of said straps being attached to and extending from said bottom edge of said panel, each of a plurality of fasteners being extendable through said straps and into the roof, said fasteners removably securing said straps to the roof when said panel is positioned adjacent to and extends upwardly from a lower edge of the roof;

an upper tether being attached to and extending between said upper hooks;

a lower tether being attached and extending between said lower hooks;

a plurality of support cables, each of said support cables being attached to and extending between adjacent ones of said posts.

* * * * *